United States Patent [19]

Dapperheld

[11] Patent Number: 4,707,226

[45] Date of Patent: Nov. 17, 1987

[54] PROCESS FOR THE DEHALOGENATION OF CHLOROACETIC AND BROMOACETIC ACID

[75] Inventor: Steffen Dapperheld, Kriftel, Fed. Rep. of Germany

[73] Assignee: Hoechst Aktiengesellschaft, Frankfurt am Main, Fed. Rep. of Germany

[21] Appl. No.: 21,991

[22] Filed: Mar. 5, 1987

[30] Foreign Application Priority Data

Mar. 7, 1986 [DE] Fed. Rep. of Germany ..... 3607446

[51] Int. Cl.[4] ..... C25B 3/06

[52] U.S. Cl. ..... 204/81; 204/73 R; 204/78; 204/130; 204/131

[58] Field of Search ..... 204/73 R, 78, 81, 130, 204/131

[56] References Cited

U.S. PATENT DOCUMENTS 4,585,533 4/1986 Habeeb ..... 204/131

4,588,484 5/1986 Justice et al. ..... 204/78 R

OTHER PUBLICATIONS

Meites et al., Anal. Chem. vol. 27 (1955), #10, pp. 1531–1533.

Elving et al., Anal. Chem., vol. 33 (1961), pp. 330–333.

Harada et al., Chem. Abstracts, vol. 91 (1979), #13216b.

*Primary Examiner*—Arthur P. Demers

[57] ABSTRACT

Chloroacetic and bromoacetic acids are dehalogenated by electrolysis of aqueous solutions of these acids using carbon cathodes and anodes likewise of carbon or of other conventional electrode materials in undivided or in divided electrolysis cells; the aqueous electrolysis solutions in the undivided cells and in the cathode area of the divided cells contain, in dissolved form, one or more salts of metals having a hydrogen excess-voltage of at least 0.4 V (at a current density of 4,000 $A/m^2$). Metals having a hydrogen excess-voltage of at least 0.4 V (at a current density of 4,000 $A/m^2$) are, for example, Cu, Ag, Au, Zn, Cd, Hg, Sn, Pb, Ti, Zr, Bi, V, Ta, Cr and Ni.

The process allows high current densities (up to about 8,000 $A/m^2$) to be used without or virtually without corrosion of the electrodes and without deposit formation on the electrodes.

6 Claims, No Drawings

PROCESS FOR THE DEHALOGENATION OF CHLOROACETIC AND BROMOACETIC ACID

Chloroacetic and bromoacetic acids are the mono-, di- and trihaloacetic acids of the formulae $CH_2ClCOOH$ $CH_2BrCOOH$
$CHCl_2COOH$ $CHBr_2COOH$
$CCl_3COOH$ $CBr_3COOH$ For many purposes, it is necessary to completely or partially dehalogenate the chloroacetic and bromoacetic acids which are produced in certain processes. Partial dehalogenation of the trihalogenated and dihalogenated acetic acids is desirable or necessary, for example, when it is intended that the monohalogenated acetic acids be obtained in highest possible yields by chlorination or bromination of acetic acid. This is because more or less significant quantities of the dihaloacetic acid and, sometimes, also the trihaloacetic acid are always produced during the chlorination and bromination of acetic acid—even when no more halogen is used than is necessary for monohalogenation—which, of course, impairs the yield of the desired monohalogen compound.

Various processes have therefore already been developed for the dehalogenation of the dihaloacetic and trihaloacetic acids and also for stopping the dehalogenation at the monohalogen stage. For example, according to the process described in DE-B No. 848,807, this dehalogenation is carried out by an electrochemical route by electrolysis of the appropriate mixtures or solutions in undivided electrolysis cells. Carbon, Acheson graphite, lead and magnetite are mentioned in name as cathode materials, and carbon and magnetite as anode materials. The presence of inert substances or inorganic impurities from the initial haloacetic acids are said not to have an interfering effect here.

According to the examples, a current density of about. 500 to 700 $A/m^2$ is used. The electrolysis temperature is below 100° C.

The material yields of the desired partially—or alternatively completely—dehalogenated products is said to be between 95 and 100% of theory.

According to Example 2, for example, the following mixture is electrolyzed:

| | |
|---|---|
| 32% | $CH_2ClCOOH$ |
| 59% | $CHCl_2COOH$ |
| 3% | $CCl_3COOH$ |
| 5% | $CH_3COOH$ |
| 1% | HCl, $H_2SO_4$, Fe and Pb salts |

The electrolysis of the mixture is carried out, according to the directions in the example mentioned, in the form of a 60% strength aqueous solution using magnetite cathodes and carbon anodes at an average voltage of 3.25 V and a current density of 500 to 600 $A/m^2$ at 65° C. until dehalogenation of the dichloroacetic and trichloroacetic acids to the monohalogen stage has occured. The yield of monochloroacetic acid is given as virtually quantitative.

In Example 4, the electrolysis is continued until complete dehalogenation—i.e. to halogen-free acetic acid.

The dehalogenation which is essential for this process is a reduction reaction which occurs at the cathode. The following reaction equation can be given for the partial dehalogenation of dichloroacetic acid to the monochloroacetic acid stage, for example:

$$CHCl_2COOH + 2H^+ + 2e \rightarrow CH_2ClCOOH + HCl$$

The reaction of the aggressive haloacetic acids at the cathode has a considerable corroding effect on the cathode material, as could also be shown by our own electrolysis experiments using magnetite and lead cathodes. The corrosion is hardly serious on carbon cathodes. However, it is disadvantageous for all cathode materials mentioned here that hydrogen evolution at the cathode occurs to an increasing extent when the current density is increased, and, in long-term experiments of more than 600 hours, the electrodes become covered with a deposit, which makes it necessary to clean the cathode, which, of course, considerably impairs the economics of the process.

The discharge of the halogen ions formed at the cathode occurs, at least partially, at the anode; i.e. in the case of chlorine ions:

$$2Cl^- \rightarrow Cl_2 + 2e$$

In undivided cells according to the abovementioned DE-B, the anodically formed halogen can easily come into contact with the product dehalogenated at the cathode and "reverse react" to form the starting material again; e.g.

$$CH_2ClCOOH + Cl_2 \rightarrow CHCl_2COOH + HCl$$

This "reverse reaction" can be prevented by carrying out the electrolysis in divided electrolysis cells. However, the diaphragm materials (for dividing the cells into a cathode area and an anode area) which were known at the time of application of the abovementioned DE-B (in 1942) did not stand up to the action of the aggressive haloacetic acids and the at least equally aggressive halogen, particularly when warm, for long. For this reason, divided electrolysis cells were also judged in the DE-B mentioned as being unsuitable for the electrolytic dehalogenation of haloacetic acids.

However, with the recent development of chemically and thermally extremely stable membrane materials made from perfluorinated polymers, it has become possible to carry out the electrolysis with aggressive reagents in divided cells.

A process for the electrochemical dehalogenation of dichloroacetic acid to the monochloroacetic acid stage in divided electrolysis cells is described in JP-A-54 (1979)-76521; special-purpose cation exchanger membranes made from perfluorinated polymers having COOH or $SO_3H$ groups on the polymer structure are used here as membrane materials.

In this process, lead or lead alloys are used as cathode materials; the catholyte is an aqueous solution of dichloroacetic acid + HCl and/or $H_2SO_4$ having a conductivity of greater than 0.01 $ohm^{-1}. cm^{-1}$.

Graphite, lead, lead alloys, and titanium with a coating of oxides of the platinum metals are mentioned as anode materials; an aqueous mineral acid solution is used as anolyte, oxo-acids being preferred as mineral acids since no chlorine, but instead only oxygen is evolved here:

$$H_2O \rightarrow \tfrac{1}{2}O_2 + 2H^+ + 2e$$

The necessary ion exchanger capacity for the membrane material is specified in grams dry weight of the exchanger resins which are necessary for neutralization of 1 gram equivalent of base. For membrane materials having carboxyl groups, the exchanger capacity should be 500 to 1,500, preferably 500 to 1,000, and for membrane materials having $SO_3H$ groups, it should be 500 to 1,800, preferably 1,000 to 1,500.

The current densities range within similar orders of magnitude as those of the process of the abovementioned DE-B No. 848,807. At a dichloroacetic acid concentration of below 25%, the current density should be below 10 $A/dm^2=1,000\ A/m^2$, at a dichloroacetic acid concentration below 15%, it should be below 800 $A/m^2$, and at a dichloroacetic acid concentratin of below 10%, it should be below 400 $A/m^2$.

Even the pure lead cathodes which are preferred here as cathodes are subject to considerable corrosion. During electrolysis using a 99.99% pure lead cathode, an electrode surface area of 1 $dm^2$ and a current density of 4 $A/dm^2=400\ A/m^2$, a cathode weight loss of 59.6 mg is said to occur over 4 hours.

The following weight loss is given for various lead alloys under the same conditions:

Pb+4% Sn: 62.3 mg

Pb+6% Sn: 64 mg

Pb+1.8% Ag: 112.4 mg

According to the examples, the current yields are always about 95% and more.

Although the known electrochemical processes for partial or complete dehalogenation of chloroacetic and bromoacetic acids have various advantages, they are, however, still in need of improvement, particularly with respect to the corrosion resistance of the cathode materials and the relatively low current densities; the object was, therefore, to improve the known processes, above all with regard to the cathode materials and the current densities, and thus to make the processes more economic.

This object could be achieved, according to the invention, by using, as initial electrolysis solutions, those aqueous solutions of chloroacetic or bromoacetic acids which contain, dissolved, one or more salts of metals having a hydrogen excess voltage of at least 0.4 V (at a current density of 4,000 $A/m^2$)

The invention therefore relates to a process for the dehalogenation of chloroacetic and bromoacetic acids by electrolysis of aqueous solutions of these acids using carbon cathodes and anodes likewise of carbon or of other conventional electrode materials, in undivided or in divided (electrolysis) cells, wherein the aqueous electrolysis solutions in the undivided cells and in the cathode area of the divided cells contain, dissolved, one or more salts of metals having a hydrogen excess voltage of at least 0.4 V (at a current density of 4,000 $A/m^2$).

Suitable salts of metals having a hydrogen excess voltage of at least 0.4 V (at a current density of 4,000 $A/m^2$) are mainly the soluble salts of Cu, Ag, Au, Zn, Cd, Hg, Sn, Pb, Ti, Zr, Bi, V, Ta, Cr and/or Ni, preferably only the soluble Cu and Pb salts. The most widely-used anions of these salts are mainly $Cl^-$, $Br^-$, $SO_4^{2-}$, $NO_3^{\ominus}$ and $CH_3OCO^-$. However, these anions cannot be combined with all the abovementioned metals in the same fashion since sparingly soluble salts are produced here in some cases (such as, for example, AgCl and AgBr; $AgNO_3$ is primarily suitable as soluble salt here).

The salts can be added directly to the electrolysis solution or alternatively generated in the solution, for example by addition of oxides, carbonates etc.—in some cases also the metals themselves (if soluble).

The salt concentration in the electrolyte of the undivided cell and in the catholyte of the divided cell is expediently adjusted to about 0.1 to 5,000 ppm, preferably to about 10 to 1,000 ppm.

Extreme corrosion resistance of the electrodes combined with the opportunity to work at current densities which are higher by a factor of about 10 (to about 8,000 $A/m^2$) is ensured by this modification of the known processes, without deposits forming on the electrodes, even in relatively long-term operation; the process is therefore extremely economic and progressive.

It was in no way to be expected, according to the state of the art, that such an increase in the economics of the process—caused particularly by the possibility of working with higher current densities without the formation of deposits on the electrodes—would be achieved by the combination of carbon cathode and the presence of certain metal salts in the electrolyte or catholyte solution.

Trichloroacetic, dichloroacetic, tribromoacetic and dibromoacetic acids, particularly only trichloroacetic and/or dichloroacetic acid, are preferably used as starting compounds for the process; the electrolysis is preferably only carried out here to the monohalogen stage (monochloroacetic or monobromoacetic acid).

It is, of course, possible to continue the electrolysis to (completely dehalogenated) acetic acid, but this is not preferred.

In principle, aqueous solutions of the initial haloacetic acids of all possible concentrations (about 1 to 95%) can be used as electrolyte (in the undivided cell) or catholyte (in the divided cell). The solutions may also contain mineral acids (for example HCl, $H_2SO_4$ etc.) and must contain the concentration according to the invention of certain metal salts.

The anolyte (in the divided cell) is preferably an aqueous mineral acid, in particular aqueous hydrochloric acid and sulfuric acid.

In principle, all possible carbon electrode materials, such as, for example, electrode graphite, impregnated graphite materials and also vitreous carbon, are suitable as carbon cathodes.

During the electrolysis, the metal on which the metal salt added according to the invention is based deposits on the cathode, which leads to a modification of the cathode properties. The cathodic current density can thereby be increased to values up to about 8,000 $A/m^2$, preferably up to about 6,000 $A/m^2$, without too vigorous hydrogen evolution and in a continuation of the dehalogenation reaction beyond the desired stage occurring as side reactions. The metal deposited on the cathode is constantly partially dissolved by the acidic solution surrounding the cathode and then redeposited etc. An interfering deposit formation on the cathode does not occur.

The same material as for the cathode can be used as anode material. In addition, the use of other conventional electrode materials, which must, however, be inert under the electrolysis conditions, is also possible. A preferred such other conventional electrode material is titanium, coated with $TiO_2$ and doped with a noble metal oxide, such as, for example, platinum oxide.

Preferred anolyte liquids are aqueous mineral acids, such as, for example, aqueous hydrochloric acid or aqueous sulfuric acid. The use of aqueous hydrochloric acid is preferred here when using divided cells and when other possible uses exist for the anodically-formed chlorine; otherwise, the use of aqueous sulfuric acid is more favorable.

Of the two possible electrolysis cells in which the process according to the invention can be carried out—undivided and divided cells—the execution in the divided cells is preferred. The same ion exchanger membranes as are also described in the abovementioned JP-A-54 (1979)-76521 are suitable here for dividing the cells into an anode area and a cathode area; i.e. those made from perfluorinated polymers having carboxyl and/or sulfonic acid groups, preferably also having the ion exchange capacities stated in the JP-A. In principle, it is possible also to use diaphragms, which are stable in the electrolyte, made from other perfluorinated polymers or inorganic materials.

The electrolysis temperature should be below 100° C.; it is preferably between about 5° and 95° C., particularly between about 40° and 80° C.

It is possible to carry out the electrolysis both continuously and batchwise. A procedure in divided electrolysis cells with batchwise execution of the cathode reaction and continuous operation of the anode reaction is particularly expedient. If the anolyte contains HCl, $Cl^-$ is constantly consumed by the anodic evolution of chlorine, which is compensated for by constant replenishment from gaseous HCl or from aqueous hydrochloric acid.

The electrolysis product is worked up in a known fashion, for example by distillation. The metal salts here remain in the residue and can be recycled into the process.

The invention is now described in greater detail by the following examples. After (invention) Examples A follow several comparison Examples B, from which can be seen that not inconsiderable corrosion and, at greater current densities, also considerable hydrogen evolution occur at magnetite cathodes (in place of carbon cathodes), even in the presence, for example, of a lead salt in the electrolyte solution. A further comparison example with a carbon cathode, but without the addition according to the invention of a metal salt to the electrolyte solution shows that hydrogen is formed here to a large extent, even at not-too-high current densities; if, in contrast, a lead salt, for example, is added to the electrolyte solution, the hydrogen evolution is suppressed and the current density can be increased.

The electrolysis cell used in all (invention and comparison) examples was a divided (plate and frame) circulation cell.

(A) Invention examples

EXAMPLES 1 to 8

Electrolysis conditions

Circulation cell with electrode surface area of 0.02 $m^2$ and electrode separation of 4 mm.

Electrodes: electrode graphite EH (Sigri, Meitingen)

Cation exchanger membrane: ®Nafion 315 (DuPont); this is a two-layer membrane made from copolymers of perfluorosulfonyl ethoxyvinyl ether + tetrafluoroethylene. A layer having the equivalent weight 1,300 is located on the cathode side, and a layer having the equivalent weight of 1,100 is located on the anode side.

Spacer: Polyethylene networks

Flowrate: 500/h

Temp.: 25°–40° C.

Current density: 4,000 A/$m^2$

Terminal voltage: 8–4.8 V

Anolyte: concentrated HCl, continuously replenished by gaseous HCl

The composition of the catholyte and the electrolysis result can be seen from the following table:

| | | 1 | 2 | 3 | 4 | 5 | 6 | 7 | 8 |
|---|---|---|---|---|---|---|---|---|---|
| Initial electrolysis solution | Metal compound in catholyte | $CdCl_2$ | $ZnCl_2$ | $CuSO_4$ | $SnCl_2$ | $Ni(NO_3)_2$ | $CrO_3$(2) | $Bi(NO_3)_3$ | $Pb(OAc)_2$(1) |
| | Concentration [ppm] | 532 | 880 | 225 | 860 | 163 | 309 | 506 | 20 |
| | Dichloroacetic acid [kg] | 0.4 | 0.27 | 0.303 | 0.397 | 0.3 | 0.65 | 0.300 | 3.0 |
| | Monochloroacetic acid [kg] | — | — | 0.475 | 0.621 | — | — | — | — |
| | Acetic acid [kg] | — | — | 0.088 | 0.116 | — | — | — | — |
| | Water [kg] | 2 | 2 | 2 | 1.8 | 2 | 1 8 | 2 | 2 |
| | Conc. HCl [kg] | — | — | — | 0.2 | — | 0 2 | — | — |
| | Current consumption [Ah] | 145 | 189 | 135 | 201 | 141 | 265 | 132 | 1124 |
| Electrolysis result | Dichloroacetic acid [kg] | 0.1 | 0.055 | — | — | — | 0.085 | — | 0.36 |
| | Monochloroacetic acid [kg] | 0.221 | 0.145 | 0.654 | 0.791 | 0.213 | 0.417 | 0.173 | 1.95 |
| | Acetic acid [kg] | — | 0.008 | 0.088 | 0.116 | — | — | — | |
| | Current yield [%] | 64 | 43 | 87 | 71.4 | 80.2 | 86 | 74 | 99.3 |

(1)Current density: 5,400 A/$m^2$, terminal voltage 5.9–5 V
(2)Converted into salt in the catholyte

EXAMPLE 9

Electrolysis conditions

Circulation cell with electrode surface area of 0.25 $m^2$ and electrode separation of 4 mm Electrodes: electrode graphite EH (Sigri, Meitingen)

Cation exchanger membrane: ®Nafion 324 (DuPont); this is a two-layer membrane of the same composition as Nafion 315, but merely with somewhat thinner layers.

Spacer: Polyethylene network

Flowrate: 1.6 $m^3$/h

Temp.: 25°–60° C.

Current density: 4,000 A/$m^2$

Terminal voltage: 6–4.5 V

Anolyte: Concentrated HCl, continuously replenished by gaseous HCl

Initial catholyte:

9.03 kg of dichloroacetic acid 14.29 kg of monochloroacetic acid 3.18 kg of acetic acid 13.20 kg of water
4 g of $CuSO_4.6H_2O$(≙25 ppm of $Cu^{2+}$)
Electrolysis result:
20.79 kg of monochloroacetic acid
0.15 kg of dichloroacetic acid
3.18 kg of acetic acid
17.2 kg of water
2.52 kg of HCl
Current consumption: 5,361 Ah
Current yield: 68.2%

(B) Comparison Example 1

Electrolysis conditions:
Circulation cell with electrode surface area of 0.02 $m^2$ and electrode separation of 6 mm
Anode: Electrode graphite EH (Sigri, Meitingen)
Cathode: Stainless steel coated completely and impermeably with magnetite
Cation exchanger membrane: ®Nafion 324 (DuPont)
Spacer: Polyethylene network
Flowrate: 500 l/h
Temp.: 39° C.
Anolyte: Concentrated HCl, continuously replenished by gaseous HCl
A catholyte having the composition
1.15 kg of monochloroacetic acid
1.28 kg of dichloroacetic acid
0.24 kg of acetic acid
1.43 kg of water
was electrolyzed at a current density of 2,000 $A/m^2$. The terminal voltage was 3.2 V. The proportion of the current which was consumed for the evolution of hydrogen was 14.3%. After addition of 0.75 g of $Pb(OAc)_2.2\ H_2O$ (100 ppm of $Pb^{2+}$), the hydrogen evolution briefly decreased, but then increased again. After 270 Ah, 28% of the current for hydrogen evolution were consumed, after 350 Ah, the value was 45%, and then increased further to about 80%. After a charge consumption of 752 Ah, an electrolyte with the following composition was obtained:
1.77 kg of monochloroacetic acid
0.42 kg of dichloroacetic acid
0.27 kg of acetic acid
1.93 kg of water
0.24 kg of HCl
0.0105 kg of iron as $Fe^{3+}/Fe^{2+}$ (from the magnetite)
$0.4.10^{-3}$ kg of lead as $Pb^{2+}$
The current yield for this slight depletion of dichloroacetic acid was only 44%. Serious corrosion damage on the magnetite layer of the cathode was noticed. The corrosion rate was 14 mg of Fe/Ah.

Comparison Example 2

A catholyte with the composition
5.72 kg of monochloroacetic acid
1.98 kg of dichloroacetic acid
2 kg of acetic acid
4.4 kg of $H_2O.HCl$
was electrolyzed at a current density of 1,250 $A/m^2$ under the conditions described in the invention examples (A) 1–8, but without addition of a metal salt. The terminal voltage was 3.9 V. After a current consumption of 1,104 Ah, the proportion of the current which was consumed for the evolution of hydrogen increased to 49%.

After addition of 10 g of $Pb(NO_3)_2$ (≙400 ppm of $Pb^{2+}$) to the catholyte, hydrogen evolution no longer occurred. It was possible to increase the current density to 4,000 $A/m^2$ (terminal voltage 4.1 V; temperature 52° C.). The hydrogen evolution side reaction commenced again at a dichloroacetic acid concentration of 3%. The current yield for the reduction of the proportion of dichloroacetic acid to 0.15 kg was 97.2%.

I claim:

1. A process for the dehalogenation of chloroacetic and bromoacetic acids by electrolysis of aqueous solutions of these acids using carbon cathodes and anodes likewise of carbon or of other conventional electrode materials in undivided or in divided (electrolysis) cells, wherein the aqueous electrolysis solutions in the undivided cells and in the cathode area of the divided cells contain, dissolved, one or more salts of metals having a hydrogen excess voltage of at least 0.4 V (at a current density of 4,000 $A/m^2$).

2. The process as claimed in claim 1, wherein the soluble salts of Cu, Ag, Au, Zn, Cd, Hg, Sn, Pb, Ti, Zr, Bi, V, Ta, Cr and/or Ni, preferably only the soluble Cu and Pb salts, are used as salts of metals having a hydrogen excess voltage of at least 0.4 V (at a current density of 4,000 $A/m^2$)

3. The process as claimed in claim 1, wherein the concentration, in the electrolysis solution, of the salts of metals having a hydrogen excess voltage of at least 0.4 V (at a current density of 4,000 $A/m^2$) is about 0.1 to 5,000 ppm, preferably about 10 to 1,000 ppm.

4. The process as claimed in claim 1, wherein trichloroacetic acid, dichloroacetic acid, tribromoacetic acid and dibromoacetic acid, preferably trichloroacetic and/or dichloroacetic acid, are used as chloroacetic and bromoacetic acids, and wherein the electrolysis is only continued to the monohalogen stage.

5. The process as claimed in claim 1, wherein the electrolysis is carried out in divided electrolysis cells.

6. The process as claimed in claim 5, wherein cation exchanger membranes made from perfluorinated polymers having carboxyl and/or sulfonic acid groups are used as membrane material in the divided electrolysis cells.

* * * * *